US005478163A

United States Patent [19]

Flügge et al.

[11] Patent Number: 5,478,163

[45] Date of Patent: Dec. 26, 1995

[54] METHOD FOR GUIDING A DOCUMENT IN A DOCUMENT-PROCESSING UNIT

[75] Inventors: Ruprecht Flügge, Bad Lippspringe; Wolfgang Neef, Meerhof; Bruno Wendland, Paderborn, all of Germany

[73] Assignee: Siemens Nixdorf Informationssysteme Aktiengesellschaft, Paderborn, Germany

[21] Appl. No.: 244,802

[22] PCT Filed: Dec. 11, 1992

[86] PCT No.: PCT/DE92/01037

§ 371 Date: Jun. 13, 1994

§ 102(e) Date: Jun. 13, 1994

[87] PCT Pub. No.: WO93/11945

PCT Pub. Date: Jun. 24, 1993

[30] Foreign Application Priority Data

Dec. 13, 1991 [DE] Germany ..... 41 41 107.2

[51] Int. Cl.[6] ..... B41J 13/16

[52] U.S. Cl. ..... 400/645; 400/23; 400/642

[58] Field of Search ..... 400/23, 279, 320, 400/322, 328, 624, 642, 708, 645, 679, 578, 174, 613.3

[56] References Cited

U.S. PATENT DOCUMENTS

| | | | |
|---|---|---|---|
| 5,000,597 | 3/1991 | Kilb et al. | 400/642 |

FOREIGN PATENT DOCUMENTS

| | | | |
|---|---|---|---|
| 2715506 | 10/1978 | Germany | 400/624 |
| 3837566 | 5/1989 | Germany | 400/624 |
| 58-151278 | 9/1983 | Japan | 400/624 |
| 63-53073 | 3/1988 | Japan | 400/624 |
| 1-206077 | 8/1989 | Japan | 400/624 |
| 1-275082 | 11/1989 | Japan | 400/624 |

*Primary Examiner*—Edgar S. Burr
*Assistant Examiner*—Steven S. Kelley
*Attorney, Agent, or Firm*—Hill, Steadman & Simpson

[57] ABSTRACT

The invention relates to a method for guiding a document in a document-processing unit, in particular a printer with a document-transporting channel. For dependable guiding of the leading edge of even arched or creased documents into the transporting channel, the document is moved to such an extent in the direction of the transporting channel that a flat document protrudes by a small amount into the transporting channel. A creased or arched document can be supported by its leading edge against the channel edge. By subsequent brushing-over movements of document-directing devices attached to the printing slide, the document is forced behind the channel edge.

5 Claims, 1 Drawing Sheet

METHOD FOR GUIDING A DOCUMENT IN A DOCUMENT-PROCESSING UNIT

BACKGROUND OF THE INVENTION

1. Field of the Invention

The invention relates to a method for dependably guiding a document in a document-processing device.

2. Description of the Related Art

A process for drawing in single-sheet paper in a printer is already known from DE 38 37 566 A1. On both sides of the print head mouth-piece there extends in the already known printer, a paper guide which can be moved together with the print head back and forth parallel to the platen. The single sheet to be printed is initially drawn into the printer, with the print head located outside the printing position, until its leading edge has just passed the printing station. Then, the print head is moved into the center of the printing region, so that the paper guide presses the paper against the printing roller. Only after this is complete is the paper brought to the line position to be printed.

In the case of the printing station known from DE 38 37 566 A1, the paper is guided around a platen, at which the normally flat paper is forced by the paper guide into a bowed shape. If is important that the paper be held closely against the platen in the region of the type line. After leaving this position, the paper resumes its flat shape. However, this presents a problem if, after leaving the printing station, the paper is to be directed by its leading edge into a paper channel, or after printing the lowest-possible line—is to be transported with its trailing edge ahead back into the feed channel. This is precisely the case with document or savings book printers, which are often designed as flat-bed printers. A flat-bed printer for the processing of document sections is known from Patent Abstracts of Japan, Volume 7, No. 271, M-260, abstract of JP, A, 58-151278.

In the case of these printers, the problem arises that non-flat documents are not satisfactorily transported and ejected. The problem is caused by the fact that, in the furthest drawn-in position, the document no longer lies with its edge, leading in the ejecting direction, in the ejecting channel and the directing or holding-down elements present there no longer influence the position of the document. This leading edge of an upwardly arched document strikes element of the ejecting channel, as a result of which creases (dog-ears) of the document are caused by the ejecting movement. It may also happen that the creased document gets caught in the ejecting channel and is torn. Outside document processing, deformations of the document occur for example due to improper storage of small document formats in the vertical position. The disadvantages which occur in the case of these printers are troublesome for the user. for example, the user must often reach into the unit to remove documents which have become caught.

Documents may also become deformed during the printing operation itself. This happens in particular in the case of needle printers which print documents in an unfavorable paper fiber direction. As a result of which—exacerbated by a low hardness of the clamping bar and under strong impact by the printing needles—a curving or arching up of the document is caused by the printing operation.

SUMMARY OF THE INVENTION

The invention is based on the object of improving the document guiding operation in printers or typewriters of the generic type in such a way that even non-flat documents are guided satisfactorily.

The object is achieved by a method for guiding a document into a transporting channel of a document-processing unit, the unit preferably having a flat-bed printer having a printing slide which can be moved along a print line and also having a print head and document-directing devices oriented thereon, a document transporting device, a printing platen lying opposite the print head, a supporting table and at least one directing baffle, arranged parallel to and at a distance from the supporting table thereby forming a transporting channel widening in the form of a funnel at the printing platen, having the steps of transporting the document by its leading edge in the direction of the transporting channel so that a flat document protrudes by a small amount into the transporting channel and an arched or creased document can be supported by its leading edge against the edge of the directing baffle, and performing at least one brushing-over movement by transversely moving the printing slide relative to the document-transporting direction.

The invention is described below with reference to an exemplary embodiment, with reference to the following figures.

DETAILED DESCRIPTION OF THE PREFERRED EMBODIMENTS

Figure 1:
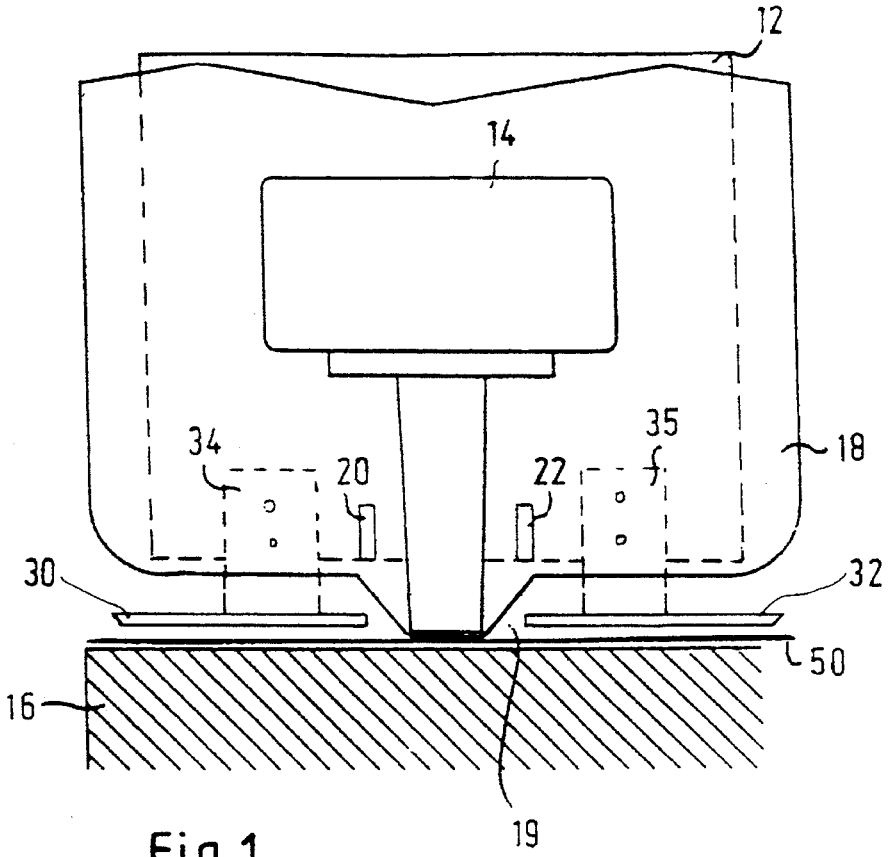
FIG. 1 shows a section through a printer or typewriter parallel to the print line direction, in which the method of the invention can be used.

As illustrated in FIG. 1, the inside of a housing of a printer or typewriter has a printing slide 12 movably oriented on a straight line parallel to a printing platen (clamping bar) 16 oriented in front of it and integrated in a supporting table 48. The mounting of the printing slide 12 on a parallel guide takes place in a known way and is therefore not described in any more detail. The printing slide 12 bears an ink-ribbon cartridge 18, a needle print head 14 and optical detecting elements 20, 22. A major component part of the detecting elements 20, 22 are light-emitting diodes (not shown in the figure), which transmit light in the direction of the clamping bar. Photoelements in the detecting elements 20, 22 measure the light reflection from the direction of the clamping bar. The dark clamping bar 16 reflects little light, whereas a document 50 reflects much light, with the result that the position of the edges of the document in the print line direction can be sensed with the detecting elements 20, 22.

On both sides in the direction of movement of the printing slide 12, the printing slide respectively bears a document-directing device 30, 32, aligned parallel to the clamping bar 16. Fastening elements 34, 35 for the document-directing devices on the printing slide 12 are indicated by dashed lines. On the clamping bar 16 there is illustrated a document 50, which is prevented from arching up in the region of the print line by the document-directing devices 30, 32.

Between the two document-directing devices 30, 32 remains a narrow gap 19 for the passing-through of the mouthpiece of the needle print head 14.

Figure 2:
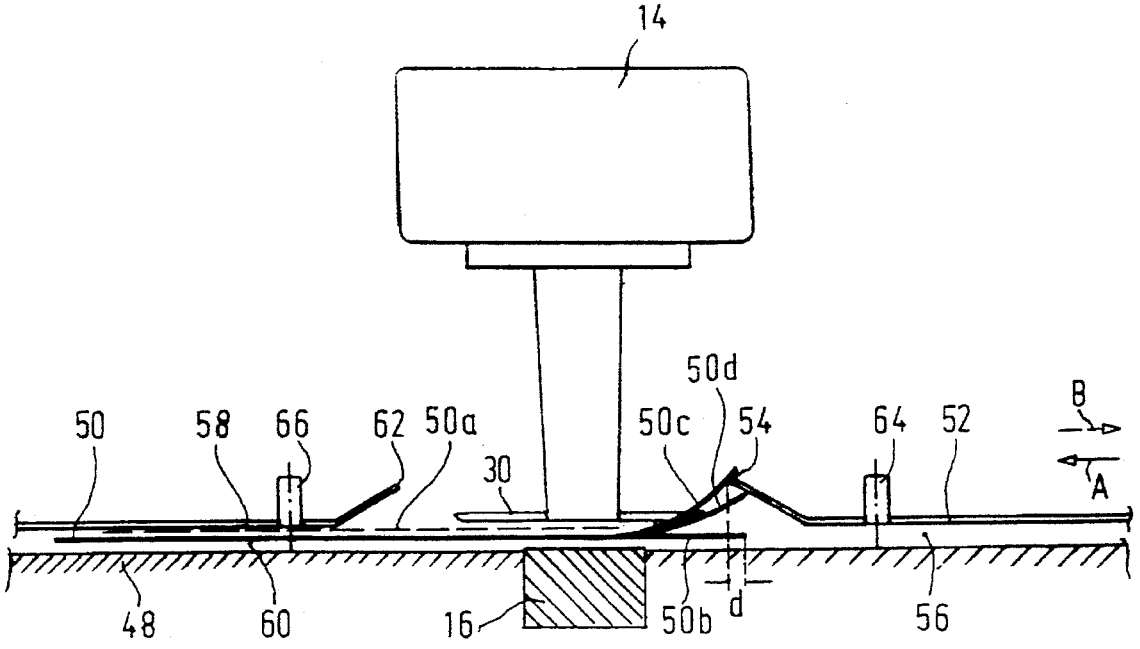
FIG. 2 shows a section transverse to the print line direction through the printer or typewriter in which the method of the invention can be used.

FIG. 2 shows the essential parts of the printer or typewriter in a section transverse to the line direction, that is to say along the transport directions A, B of the documents 50 to be printed.

As already described, the clamping bar 16 is recessed into the supporting table 48 underneath the print head 14. Upstream of the print head 14 in feeding direction A there is arranged at a small distance from and parallel to the supporting table 48, a directing baffle 52, which is bent off upward at its end close to the print head and ends in an edge 54. The directing baffle 52 thus forms a feed channel 56, which widens in the form of a funnel near the print head.

Downstream of the print head 14 in feeding direction A, a second directing baffle 58, oriented parallel to and at a small distance from the supporting table 48, forms with the supporting table 48 a conveying-away channel 60. The directing baffle 58 is likewise bent off upward at its end close to the print head 14 and ends in an edge 62. In the feed channel 56 there is built in a light barrier 64. In the conveying-away channel 60 there is built in a light barrier 66. The light barriers 64, 66 serve for detecting the leading and trailing edge of the document 50.

The last line of a document is printed in a position in which the document is drawn to the greatest extent into the printer. Document delivery takes place in the direction of the arrow B against the feeding direction by reversing the transporting direction of the transporting devices. In the furthest drawn-in position, the document is no longer held down by the directing baffle 52, as is shown in FIG. 2 for a document 50*a* indicted by dashed lines. The document trailing edge is located outside the feed channel 56.

When the document is conveyed back in the direction of the arrow B, in the method of the invention, sequences of movements which result in non-flat and arched-up documents being forced into the feed channel 56. This is accomplished by brushing-over movements of the document-directing devices 30, 32 attached to the printing slide 12 over the entire length of the leading edge of said documents.

In a first method step according to the invention, the document is advanced in delivery direction B only to such an extent that it is guided by a small amount d into the funnel-shaped starting part of the feed channel. A displacement d of about 2 mm has proved to be favorable as the depth of penetration.

In FIG. 2, documents with different degrees of deformation are shown. A flat document 50*b* will run into the feed channel 56 without knocking into anything. A severely arched document 50*c* is advanced to just the same extent as a flat document, since the printer control is not aware of this difference, and is stopped. As a result of its arching the severely arched document 50*c* comes to bear against the bent-up edge 54 of the directing baffle 52. The severely arched document 50*c* may even bend away from this edge in the direction of the print head. The print head 14 is then moved in the line direction. The document-directing devices 30, 32 thereby bend the document edge downward to such an extent that it flips under the edge 54 of the directing baffle 52 and, even after passing-by of the document-directing devices 30, 32, can at most arch up into the position shown at 50*d*. In the position shown at 50*d*, the document is still dependably deflected by the directing baffle 52 into the feed channel 56. After the brushing-over movements, the transporting device is switched on again and further conveys the document dependably in the feed channel 56 in direction B.

In the second method step, the movement of the printing slide 12 is controlled such that, starting from the last print position, it is moved in a first brushing-over movement in the direction of a document side edge. The document-directing devices 30, 32 on the printing slide press the document in the direction of the clamping bar 16. Depending on the type of printing slide, it is even possible to dispense with special document-directing devices if the printing slide and the ink-ribbon guides assume the function of the document-directing devices 30, 32.

In further steps of the method of the invention, the printing slide 12 is moved successively in the direction of the two document side edges. By both brushing-over movements, the document trailing edge, standing up due to deformation in the ejecting direction is pressed over its entire length into the feed channel 56 and, in the further ejecting movement, is taken up dependably over the entire length of the trailing edge by the directing baffle 52 of the feed channel 56. In the final ejecting movement, the document is able to be transported without creasing.

In an advantageous further embodiment of the method of the present invention, an additional brushing-over movement of the printing slide takes place before transporting the document in the direction of the feed channel 56.

Only thereafter does the transporting device push the document forward in delivery direction B, until the document edge has been advanced by a small amount into the funnel-shaped part of the feed channel 56. The previously mentioned brushing-over movement follows.

In a further embodiment of the present method described, in the first brushing-over movement the movement of the printing slide is controlled such that, starting from the last print position, said slide is moved over the first side edge of the document and beyond to its end position in the print line. In the second brushing-over movement, the printing slide is moved over the second document side edge and beyond again to its end position. As already described, by the two brushing-over movements, the document edge standing up due to deformation in ejecting direction B is pressed over its entire length into the feed channel 56 and, in the further ejecting movement, is taken up dependably over the entire length of the trailing edge by the directing baffle 52.

In another embodiment of this method, the signals of the optical detecting elements 20, 22 on the printing slide 12 are used. The elements detect the side edges of the document. The signals of the document side edge detectors 20, 22 are used for controlling the brushing-over movements. Both brushing-over movements then proceed only up to the time at which the side edge is detected. The printing slide stops in this position and returns. With this method sequence according to the invention, the time for the brushing-over movements is minimized by virtue of the shorter displacements.

The drives for document transport are generally designed with stepping motors. These stepping motors are actuated in smallest-possible steps for the transporting steps according to the invention in drawing-in direction and delivery direction. For example, a step increment of 1/180 inch can be actuated, in comparison with a normal step increment of 1/6 inch.

The first brushing-over movement of the printing slide preferably takes place in the direction of the document side edge furthest away from the current print head position. The position of the document side edges is sensed by further optical detecting devices (not shown), which are integrated in the transporting device. The position of the last print position is taken from the electronic control of the printing operation. From this, the two displacements to the document side edges are respectively calculated electronically and the longer displacement is actuated first.

In the case of narrower documents, the print head may remain in the end position of the last brushing-over movement. At least in the case of wide documents, the printing slide is moved into the middle of the document by an additional movement.

It is evident that the method according to the invention can be used not only when ejecting a document. During drawing into the printing station, documents with arched-up leading edge can in the same way be reliably directed under the directing baffle 58 and consequently into the conveying-away channel 60.

Although other modifications and changes may be suggested by those skilled in the art, it is the intention of the inventors to embody within the patent warranted hereon all changes and modifications as reasonably and properly come within the scope of their contribution to the art.

We claim:

1. A method for guiding a document into a transporting channel of a document-processing unit, said transporting channel being defined by a directing baffle spaced above a supporting table, said directing baffle having an edge, said document-processing unit including a flat-bed printer, having a printing slide constructed and arranged to move along a print line, said printing slide further having a print head and document-directing devices arranged on said print head for movement therewith comprising the steps of:

after printing transporting said document by its leading edge toward said transporting channel so that a flat document protrudes by a small amount into said transporting channel and an arched or creased document can be supported by its leading edge against said edge of a directing baffle; and performing at least one brushing-over movement by transversely moving said document-directing devices arranged on said printing slide of said document-processing unit relative to said document-transporting direction.

2. The method of claim 1, comprising the additional step of performing a second brushing-over movement with said document-directing devices arranged on said printing slide prior to said transporting step.

3. The method of claim 2, wherein said brushing-over movements of said document-directing devices arranged on said printing slide occur up to an end-of-line position.

4. The method of claim 2, said document-processing unit having detecting devices for detecting the side edges of said document, wherein said brushing-over movements of said document-directing devices arranged on said printing slide occur only up to said document side edge.

5. The method of claim 1, comprising the additional step of moving a print head of said document-processing unit after said brushing-over movement to approximately the center of said document before said transporting step.

* * * * *